US007182331B2

(12) United States Patent
Berdelle-Hilge et al.

(10) Patent No.: US 7,182,331 B2
(45) Date of Patent: Feb. 27, 2007

(54) INPUT UNIT OF A LETTER SORTING SYSTEM AND METHOD FOR LOADING THE INPUT UNIT

(75) Inventors: Peter Berdelle-Hilge, Constance (DE); Christoph Hofmann, Salem (DE)

(73) Assignee: Siemens AG, München (DE)

( * ) Notice: Subject to any disclaimer, the term of this patent is extended or adjusted under 35 U.S.C. 154(b) by 730 days.

(21) Appl. No.: 10/370,510

(22) Filed: Feb. 24, 2003

(65) Prior Publication Data

US 2003/0173259 A1 Sep. 18, 2003

Related U.S. Application Data

(63) Continuation of application No. PCT/DE01/03701, filed on Sep. 26, 2001.

(30) Foreign Application Priority Data

Sep. 29, 2000 (DE) ..... 100 48 827

(51) Int. Cl.
*B65H 1/14* (2006.01)

(52) U.S. Cl. ..... 271/150; 271/157; 414/798.7

(58) Field of Classification Search ..... 271/150, 271/157, 158, 234; 414/401, 798.2, 798.7
See application file for complete search history.

(56) References Cited

U.S. PATENT DOCUMENTS 4,042,234 A * 8/1977 Tokuno ..... 271/151
4,172,531 A * 10/1979 Muller ..... 414/798.7
5,829,742 A * 11/1998 Rabindran et al. ..... 271/150
5,906,468 A 5/1999 Vander Syde et al.
5,947,468 A 9/1999 McKee et al.
6,568,672 B2 * 5/2003 Keller ..... 271/177

FOREIGN PATENT DOCUMENTS

DE 4236507 12/1993
EP 0865328 6/1997

OTHER PUBLICATIONS

DE4236507-C1 Derwent Abstract.

* cited by examiner

*Primary Examiner*—Janice L. Krizek
(74) *Attorney, Agent, or Firm*—Jacob Eisenberg; Siemens AG

(57) ABSTRACT

The present invention relates to an input unit of a letter sorting system which comprises separable first and second conveyor lines. The first line is positioned proximate to an isolating device which processes letters. The first line comprises a conveyor surface and supporting wall along with a linear guide which extends beyond the surface. On the linear guide runs a separating blade. The second line also comprises a conveyor surface and supporting wall along with a linear guide, however this linear guide does not run beyond the length of the second conveyor line supporting surface. At least one second separating blades run on the second conveyor line linear guide. In operation, letters are placed on the second conveyor supporting surface from bins. The placement may be in a select order. The second conveyor line is then brought proximate to the first conveyor line where the two are then coupled. The conveyor surfaces of the two lines substantially mate so as to facilitate transported by a separating blade of the letters from the second to the first conveyor line and then to the isolating unit for processing.

17 Claims, 7 Drawing Sheets

INPUT UNIT OF A LETTER SORTING SYSTEM AND METHOD FOR LOADING THE INPUT UNIT

CONTINUATION DATA

The present invention is a continuation of and claims priority to international application: PCT/DE01/03701, filed Sep. 26, 2001, and further claims priority to German patent application 10048827.7, filed Sep. 29, 2000, both of which are incorporated herein by reference.

STATEMENT REGARDING FEDERALLY SPONSORED RESEARCH OR DEVELOPMENT

Not applicable.

REFERENCE TO SEQUENCE LISTING, A TABLE, OR A COMPUTER PROGRAM LISTING COMPACT DISK APPENDIX

Not applicable.

BACKGROUND OF THE INVENTION

The present invention relates to an input unit of a letter sorting system including a mail or letter isolating device connected to a mail conveyor line and oriented horizontally with a supporting wall. Relatively flat mail pieces are transported, with the assistance of separation blades, to the isolating device. The mail pieces are standing on edge. The separation blades may be made to swivel into a stack of mail pieces in facilitating transport of a select portion of the stack as well as provide support therefor. The separation blades further run on linear guides which facilitate linear transport of a select stack portion.

To date, input units are loaded manually. This is a rather expensive undertaking. Herein, mail pieces are dumped from a mail container of a mail conveyor line, or manually removed stack-wise from the mail container, and put on the mail conveyor line. Thereafter, the mail pieces are moved, again by hand, along a supporting base and oriented side-wise against a supporting wall and to the mail isolating device. The separating blade is then swiveled in behind the stack and mail separation or isolation starts. The separating blade and additionally the optional mail conveyor line, which is executed as conveyor coupled with the separating blade, supplies the stack in a pressure-controlled manner to the isolating device.

EP 0865328 B1 sets out an installation for an automatic loading of an input unit of a letter sorting system without manual input. A loaded container is thereby emptied by a loading module on the mail conveyor line of the input unit between two additional, moveable and swiveling separating blades. Then the stack is automatically moved to the remaining stack by the two separating blades in a direction of the mail isolating device. The separating blade, which supports the remaining stack, extends, advances closely behind the additional rear separating blade, swivels in again and the two additional separating blades swivel out and advance to the back for the capture of a new stack. With this solution too, the mail pieces get to the input unit in a mail container, i.e. the mail pieces have to be loaded in the mail containers in a relatively expensive manner. These mail pieces come in many cases from pre-arranged sorting machines. Then the pre-sorted mail pieces are loaded from the respective sorting bins into the mail containers and, as described, transported to the corresponding input unit.

There are also sorting processes with several successive sorting runs, where the mail pieces from the sorting bins are not loaded into the mail containers, but moved by a transfer bridge from the sorting bins on the mail conveyor line of the input unit (see e.g. DE 42 36 507 C1). For this, a certain machine layout is necessary where the sorting bins and the mail conveyor line of the input unit are opposing.

SUMMARY OF THE INVENTION

The present invention is directed to a letter sorting system input unit and a method for loading it wherein mail piece loading assistance from prearranged sorting plants into mail containers is no longer necessary; or no requirements regarding the spatial arrangement of input unit and sorting bins are necessary for machine-layouts with sorting processes of several sorting runs; whereby the respectively sorted mail pieces are fed directly to the input unit again without a mail container.

The execution of a mail conveyor line as a divided mail conveyor line, whereby a relatively short first section is, as up until now, connected firmly to the mail isolating device, and at least one longer second section, connectable to the short section, which is arranged traveling on an carriage, permits the direct loading of the mail conveyor line at any location without using mail containers. The second section of the mail conveyor line is thereby carried to the loading location and the mail pieces are placed on the second section. One or two separating blades are pushed towards the stack along the second section so that the mail stack does not turn over. If the mail stack is not too long, one separating blade is sufficient at a determined oblique position; otherwise support on both sides with two separating blades is preferred, particularly with uncontrolled transport motions. A supporting wall, which is connected to a first section of the mail conveyor line, has a length over the entire mail conveyor line. The separating blade of the first short section of the mail conveyor line travels over the length of the entire mail conveyor line, i.e. if the second section is coupled, this first separating blade can be advanced, extended behind the rear separating blade of the second section, and, after joining with the optional remaining stack on the first section and the swiveling out of the separating blades of the second section, move the entire stack to the isolating device. The separating blades are placed in such a way, that they don't hinder each other while in motion.

So it is advantageous to carry out the first section of the mail conveyor line at least as long as is sufficient to isolate or sort a mail stack standing on it, to disconnect the coupled and by now empty second section of the mail conveyor line, and to couple a new, loaded second section to the first section. It is thereby possible to operate the mail isolating device for a sorting run without interruption.

It is further advantageous to place the separating blade of the first section and the separating blade or blades of the second section guided on both sides of the mail conveyor line and moveable along the conveyor line in order to avoid mutual interference when the separating blades are in motion.

It is also advantageous to move the first separating blade of the mail conveyor line in a direction of the mail isolating device by a shifting device which keeps the measured stacking pressure constantly regulated at the mail isolating device. Practically similar emptying conditions are thereby met during the separating of the entire mail stack.

To carry out the transport of the mail pieces to the mail isolating device as stress-free as possible, the base of the first and the second section of the mail conveyor line each comprise at least a partially rough conveyor belt which are substantially synchronized with the first swiveling separating blade when the mail stack is moved to the mail isolating device. During the connection of the two sections, the drives of the two conveying belts, advantageously via use of friction wheels, may also be so coupled.

To prevent mail piece dislocation during the pushing together of mail pieces of the loading process of the second section, the pushing being against the rear separating blade in a direction of the mail isolating device, the conveying belt may be limited to a motion only in a direction of the mail isolating device.

It is further advantageous, to advance the second section of the mail conveyor line to the sorting bins of any letter sorting system and to load from the sorting bins. These are advantageously the sorting bins of the letter sorting system, which input unit has to be loaded several times, at a sorting process with several sorting runs.

The present invention still further comprises a sorting system for a plurality of letters, comprising: a letter isolating unit, a first conveyor line for conveying letters to said letter isolating unit, said first conveyor line comprising: a first conveyor surface for supporting and transporting said letters; a supporting wall for supporting said letters, said wall running along said first conveyor surface; a first separating blade for supporting said letters and facilitating transport of said letters to said unit; and a linear guide for guiding said first separating blade, said guide running beyond a length of said surface; and a second conveyor line for conveying said letters to said first conveyor line, said second conveyor line being mounted on a moveable carriage and comprising: a second conveyor surface for supporting and transporting said letters; coupling means for functionally associating said second conveyor line to said first conveyor line such that letters supported by said second conveyor surface may be transported to said first conveyor surface by said first blade, at least one second blade for supporting and transporting said letters; and a second linear guide for guiding said at least one second blade.

The present invention also comprises a method of providing letters to a letter sorting system, comprising the steps of: stacking said letters on a first conveyor line, said conveyor line being mounted on a moveable chassis; relocating said first conveyor line proximate to a second conveyor line, said second conveyor line comprising a separating blade running on a linear guide having a length greater than said second conveyor line; coupling said first and second conveyor line, such that said letters may be transported from said first to said second conveyor line; and transporting said letters from said first to said second conveyor line using said separating blade.

BRIEF DESCRIPTION OF THE SEVERAL VIEWS OF THE DRAWINGS

The novel features and method steps believed characteristic of the invention are set out in the claims below. The invention itself, however, as well as other features and advantages thereof, are best understood by reference to the detailed description, which follows, when read in conjunction with the accompanying drawing, wherein:

DETAILED DESCRIPTION OF THE INVENTION

The present invention is set out by way of example with application to mail piece or letter handling. The terms will be used interchangeably throughout. However, as would be clear to one skilled in the art, the present invention has application outside of the letter handling arts. The mail pieces in the present example are sorted according to the delivery needs of the letter carriers. Because a sorting plant only possesses a limited number of sorting bins 14, such sorting must be carried out in several successive sorting runs. In these runs the mail pieces of the input unit are fed to the sorting bins in the sorting order. The mail pieces are stacked upright, from back to front, within the sorting bins 14. The pieces are supported towards the front by a rotating in or swiveling pallet which resiliently presses against the growing stack of mail pieces. The emptying of the sorting bins 14 and the loading of a mobile second section 30 of the mail conveyor line of the input unit may then easily occur by moving the mail stack from the sorting bin 14 onto the second section 30.

The following sorting strategy may be employed for a sorting strategy. The following is based on a two-pass process:

1. The mail pieces are loaded on the second section of the mail conveyor line and sorted.
2. After completion of the first run, the mail pieces are brought back to the input unit and sorted a second time. The emptying order of the sorting bins is maintained.
3. After the second pass, the mail pieces are packed into transport containers.

The mail stacks are loaded from the sorting bins 14, after the first run of one or several second sections 30 of the mail conveyor line, which are distributed along the letter sorting system. The second sections may be mounted on a movable chassis. The individual mobile sections are then advanced to the input unit and emptied.

Figure 1A:
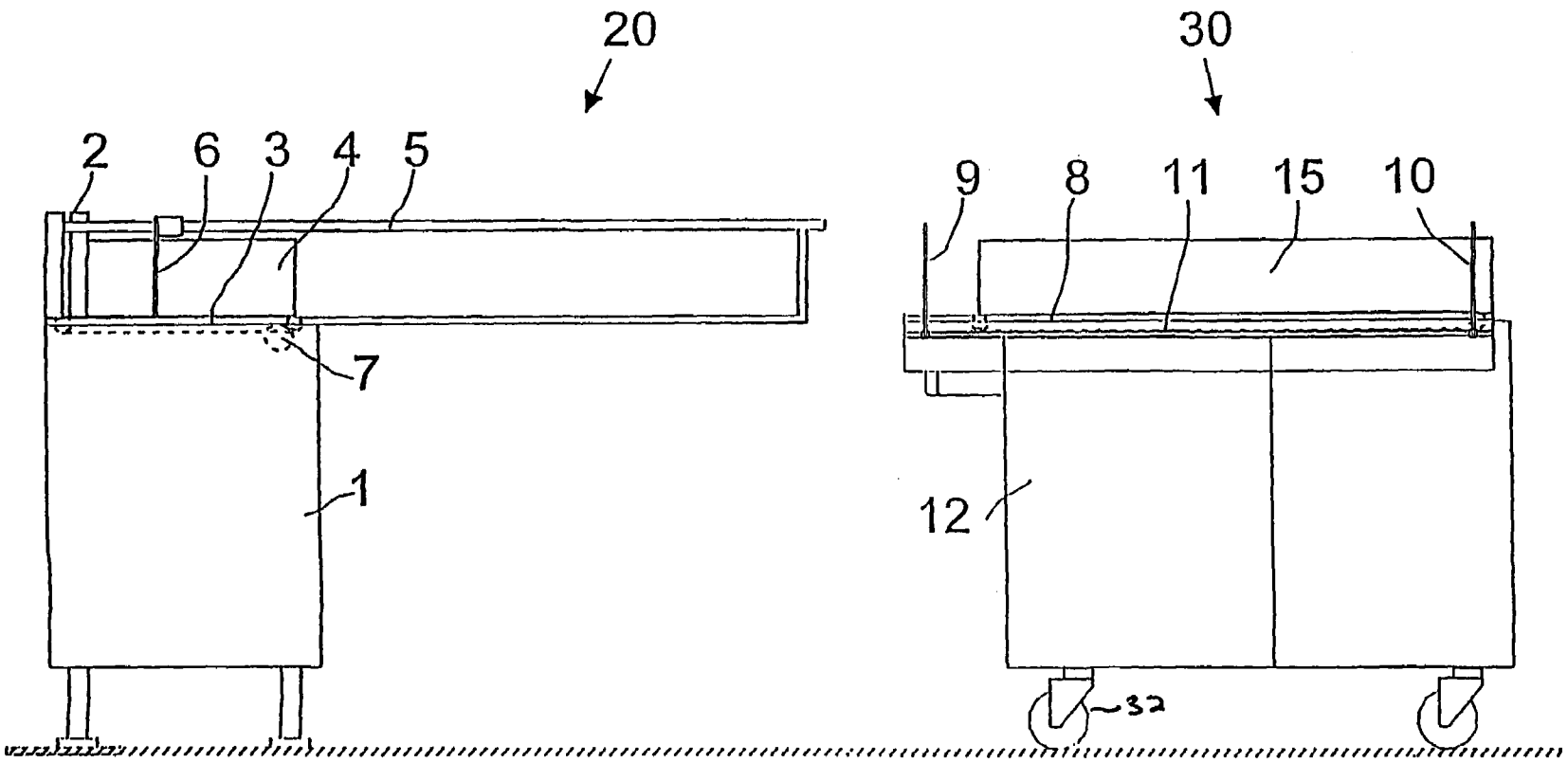
FIG. 1*a* depicts a schematic side view of the input unit with uncoupled conveyor lines.
Figure 1B:
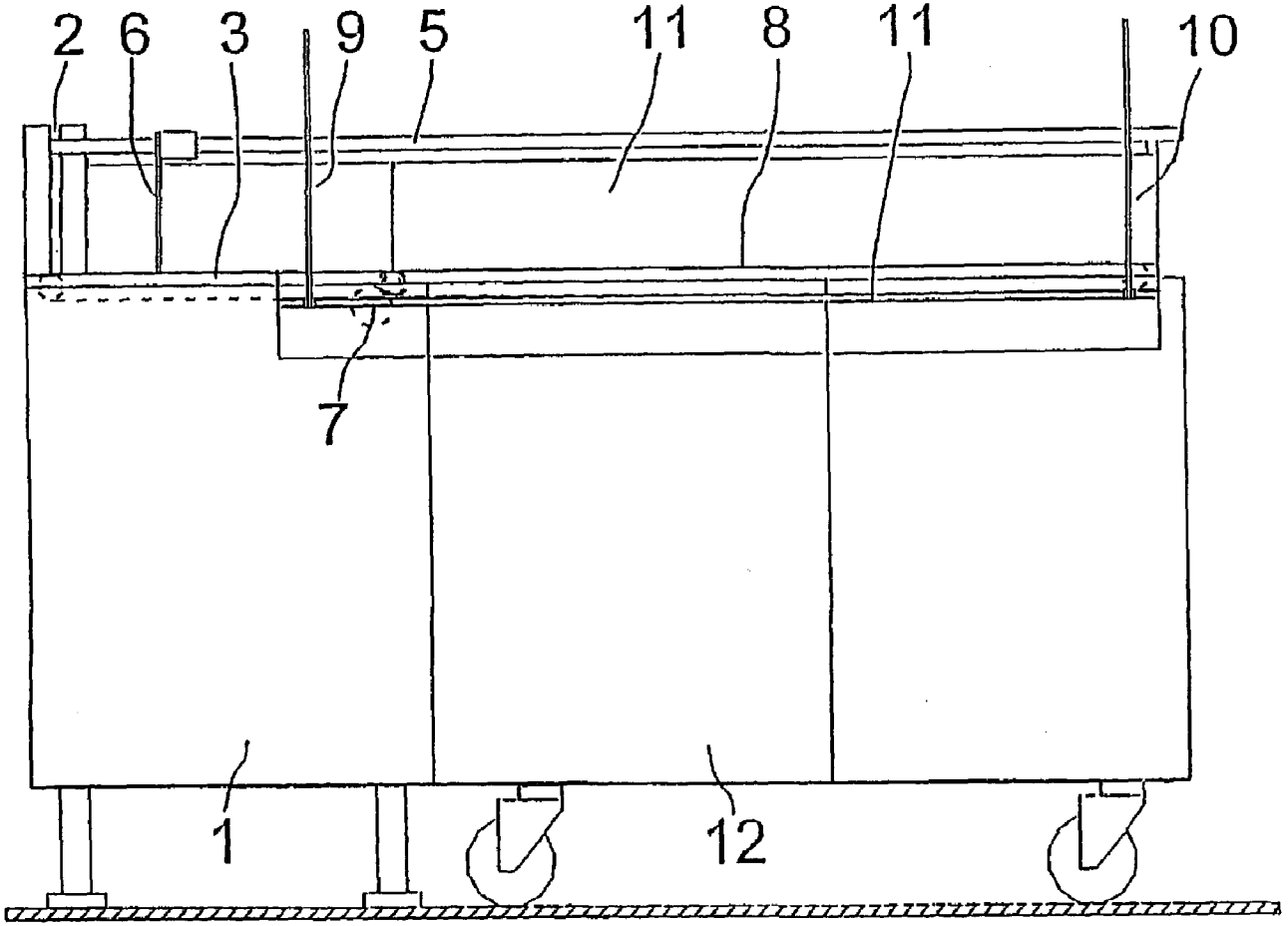
FIG. 1*b* depicts a schematic side view of the input unit with coupled conveyor lines.

Reference is now made to FIGS. 1*a* and 1*b*. The two figures depicts a first and second sections of a mail conveyor line or a first and second conveyor line 20 and 30, respectively. The FIGS. 1*a* and 1*b* differ in that the former depicts the two sections apart, while the latter depicts the two functionally coupled together. Referring to FIG. 1*a*, first conveyor line 20 comprises a base or first conveyor surface 3 for supporting one or a plurality of mail pieces. The mail pieces are normally placed on the base in a stack, the mail pieces standing on an edge or side. The mail piece stack may lean against a support wall 4 for support. Wall 4 runs an approximate length of surface 3. Surface 3 facilitates transport of the letters towards isolating device which separates and/or sorts the letters. Movement of the letters may be facilitated by the surface comprising a conveyor belt. The first conveyor line further comprises a linear guide 5 which runs beyond the length of surface 3. Guide 5 facilitates lateral movement of separating blade 6 which may further be made to swivel or pivot about guide 5. Accordingly, blade 6 may be positioned laterally about guide 5 and rotated into place behind a distal (with respect to isolating unit 2) end of the mail pieces and further made to urge the mail pieces, from behind, in the direction of the isolating unit 2. The pressure from blade 6 may be made to be constant over the stack. Such may also be facilitated by cooperation of the conveyor belt. Appropriate control means (not shown) may be included to facilitate this. The isolating unit may also be referred to as the singling unit. The first conveyor line is further mounted on a stationary base 1 and includes a friction wheel 7 for operating the conveyor belt.

With further reference to FIG. 1*a*, the second section of the mail conveyor line or second conveyor line 30 is attached or mounted on a carriage or chassis 12. The chassis is mobile and may include wheels 32 and other mobility means envisioned by the skilled artisan to facilitate transport of the second conveyor line 30 to and from the first conveyor line 20. Such mobility may be manually or automatically effected. Returning to second conveyor line 30, it further comprises two second separating blades 9 and 10 which run along a linear guide 11. The number of blades is a design choice both with the first and second conveyor lines. As with the first separating blade, second separating blades may be made to pivot about linear guide 11 as well as be laterally displaced. A second supporting wall 15 is also included which, in cooperation with the blades and second supporting surface or second base 8, support one or a plurality of mail pieces. The mail pieces may be accommodated in a stack, the stack being taken from sorting bins (discussed below). The stack may further be supported by a sandwiching effect of opposing second blades positioned on opposing sides of the stack. This prevents the stack from topping over and the like. Second conveyor surface 8 may be located at a substantially similar height and attitude as the first conveyor surface 3.

With reference to both FIGS. 1*a* and 1*b*, line guide 5 may substantially equal the total combined lengths of the first and second conveyor surfaces (6, 8) and or first and second conveyor lines (20, 30). The length of surface 6 may be chosen in such way that the time necessary to singularize or sort mail pieces standing on it sufficiently accommodates exchange of second conveyor line 30. The exchange would be effected when the second section 30 is empty of mail pieces. The exchange time may also include the time needed to position first separating blade behind separating blade 10 and into position to urge a stack of letters sitting atop the second section towards the first section. Accordingly, mail sorting is not interrupted.

FIG. 1*b* depicts a coupling of the two lines 20 and 30. The two may be interlocked via tooth mechanism, as is known in the art, which facilitates functional association of the first and second conveyor surfaces 6 and 8. Second conveyor surface 8 may also comprise a conveyor belt which may be made to run in association with the conveyor belt of the first conveyor surface 6. The ends of the two sections 20, 30, which are coupled together, are formed out in such a way, that they seize into one another with a tooth characteristic, so that no disturbing gap is produced. Accordingly, the two surfaces mate to form a single surface sufficient for transport of letters from one line to the other. The transport may be facilitated by at least one of the conveyor belts in association with at least separating blade 6. Alternative use of these urging means is within the scope of operation. Furthermore, friction wheel 7 may be used to power both conveyor belts. Likewise, the number of conveyor belts is a design choice.

The conveying belt of the second section 30 is only moveable in the direction of the isolating unit, so that the mail pieces don't slip away when pushed together during the loading process against the rear swiveled in separating blade 9 in the direction of the mail isolating device, which supports itself on the conveying belt and is connected to it form and force-fit.

Figure 3A:
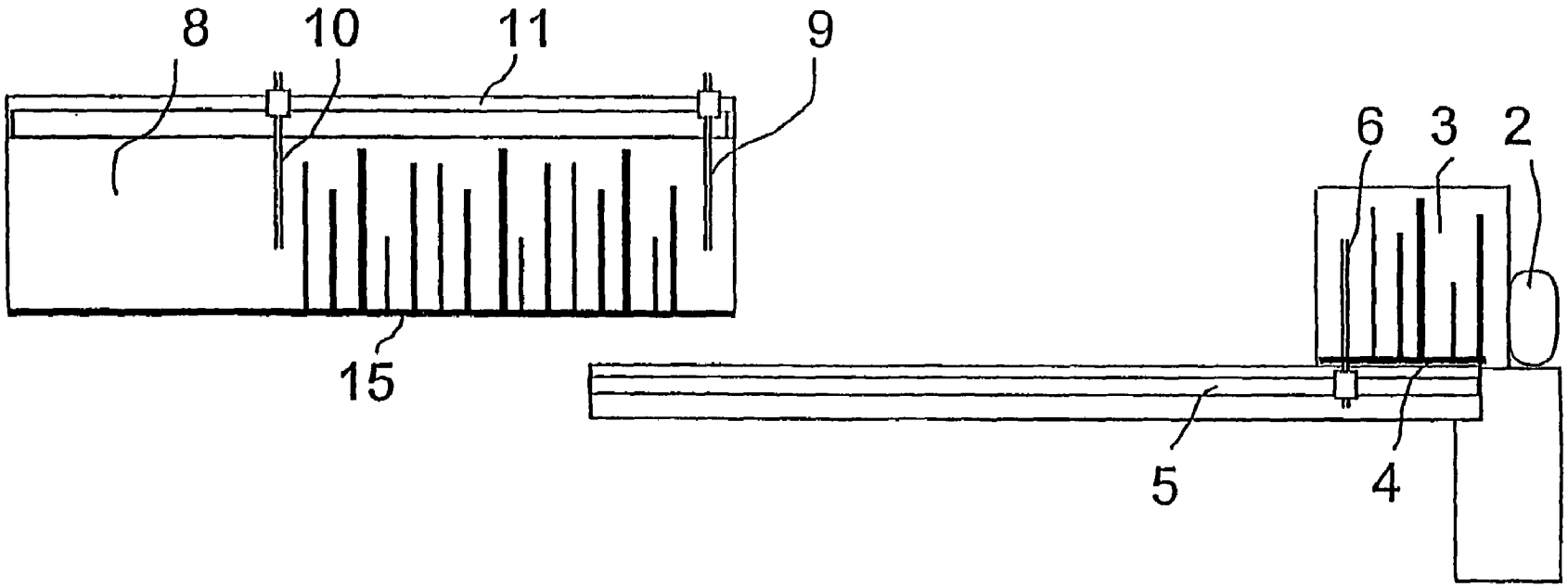
FIGS. 3*a*, 3*b* and 3*c* depict several phases of a loading process in schematic form.
Figure 3B:
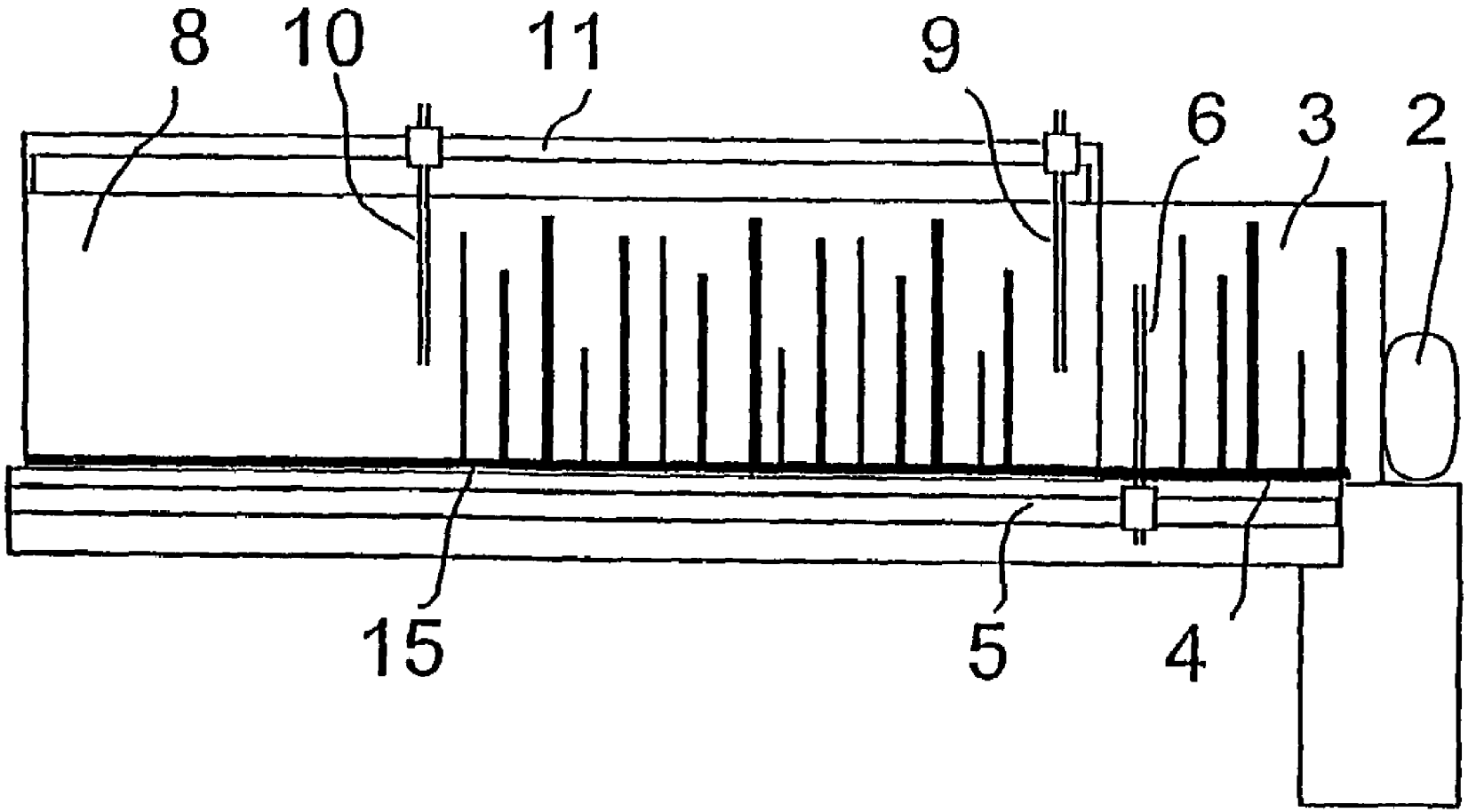
Figure 3C:
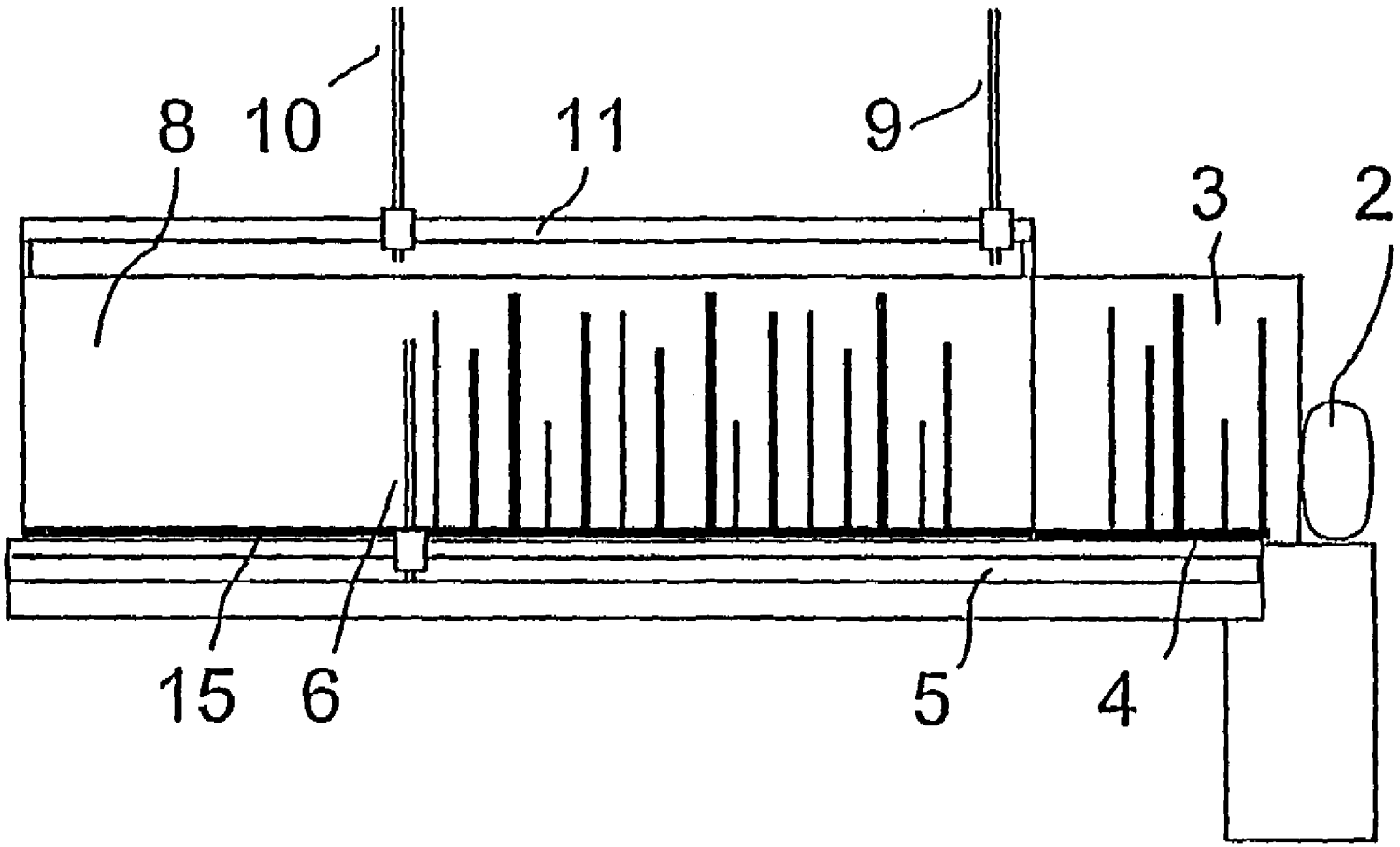

Skipping to FIGS. 3*a*–3*c*, it is herein depicted the transport of letters from the second to the first conveying lines. In FIG. 3*a*, letters sandwiched between blades 9 and 10 are transported to the first conveying line—the two are still separated. The letters currently stand on surface 8 supported by wall 15. Some letters are being processed by unit 2 on the first conveyor line. These letters are supported by wall 4 and stand on surface 3. Separating blade 6 urges these letters towards unit 2. FIG. 3*b* shows the coming together of the two conveying lines, the surfaces of which substantially mate as described above. In FIG. 3*c*, the second separating blades 9, 10 are rotated away from the letters; first separating blade 6 is positioned behind the letters of the second conveying line; and with the urging of the first separating blade (and optionally the conveying belts of either or both conveying lines) the letters of the second conveying line come to join the letters of the first conveying line enroute to processing by unit 2. The order of the letters as received from the sorting bins to the second conveying line is preserved.

A first loading scheme is suggested with reference to 2*a*. Herein, the second section of the mail conveyor line located on a carriage, is put at a 90° angle against the bin wall 13, itself including sorting bins 14. First, the contents of bin no. 1, which is deposited to the left of the front separating blade is loaded. Thereafter, the contents of bin no. 2 is deposited to the left of the contents of bin no. 1. This process is continued. With the separating blade no. 2 of the second section, a turn-over to the left of the stack can be prevented. This separating blade is only brought into use if the deposited stack exceeds a certain oblique position. At a length of the second section of for example 1 m, 3 shifts need to be calculated per load.

Figure 2A:
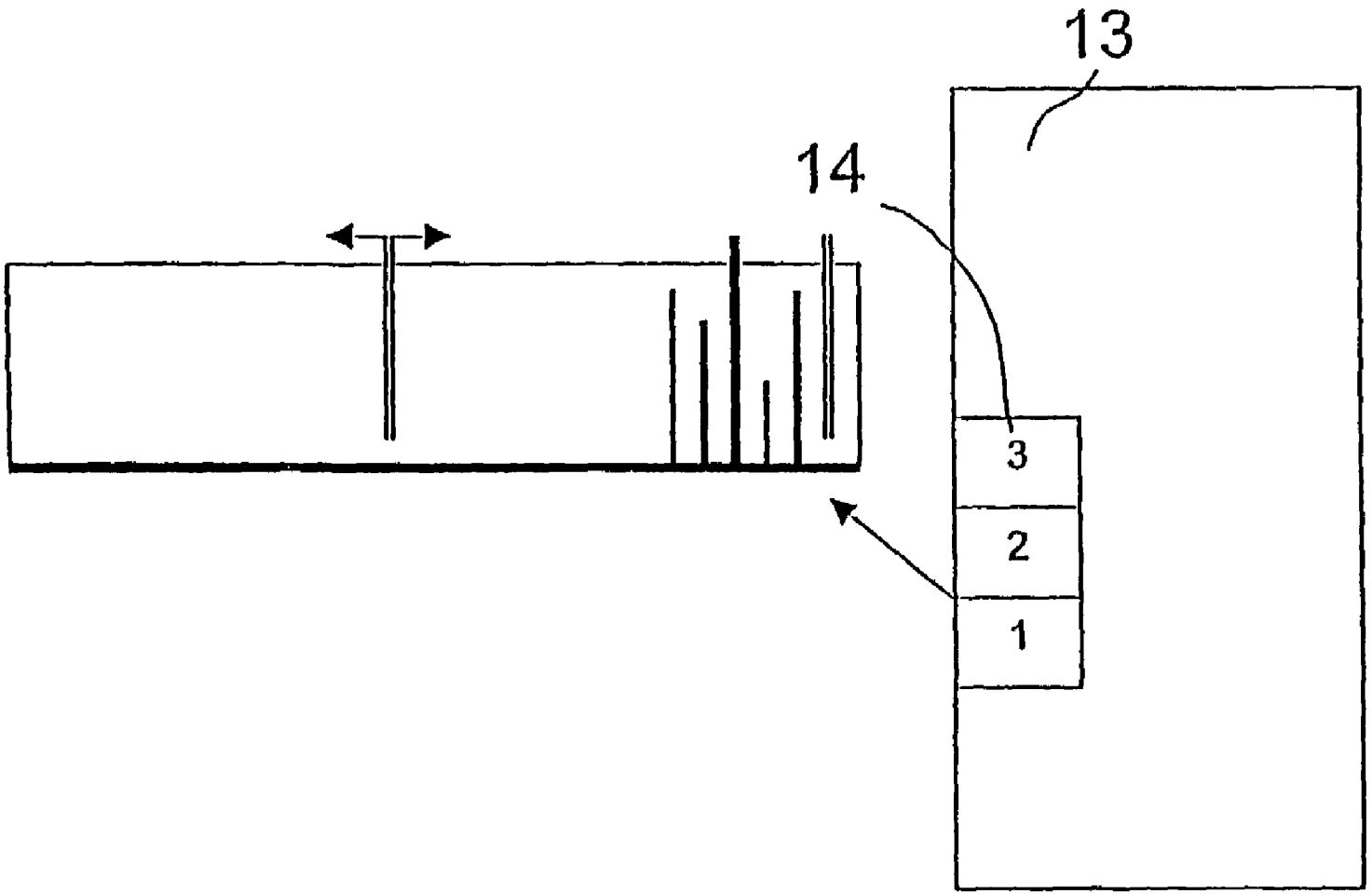
FIGS. 2*a* and 2*b* depict different second section loading schemes.
Figure 2B:
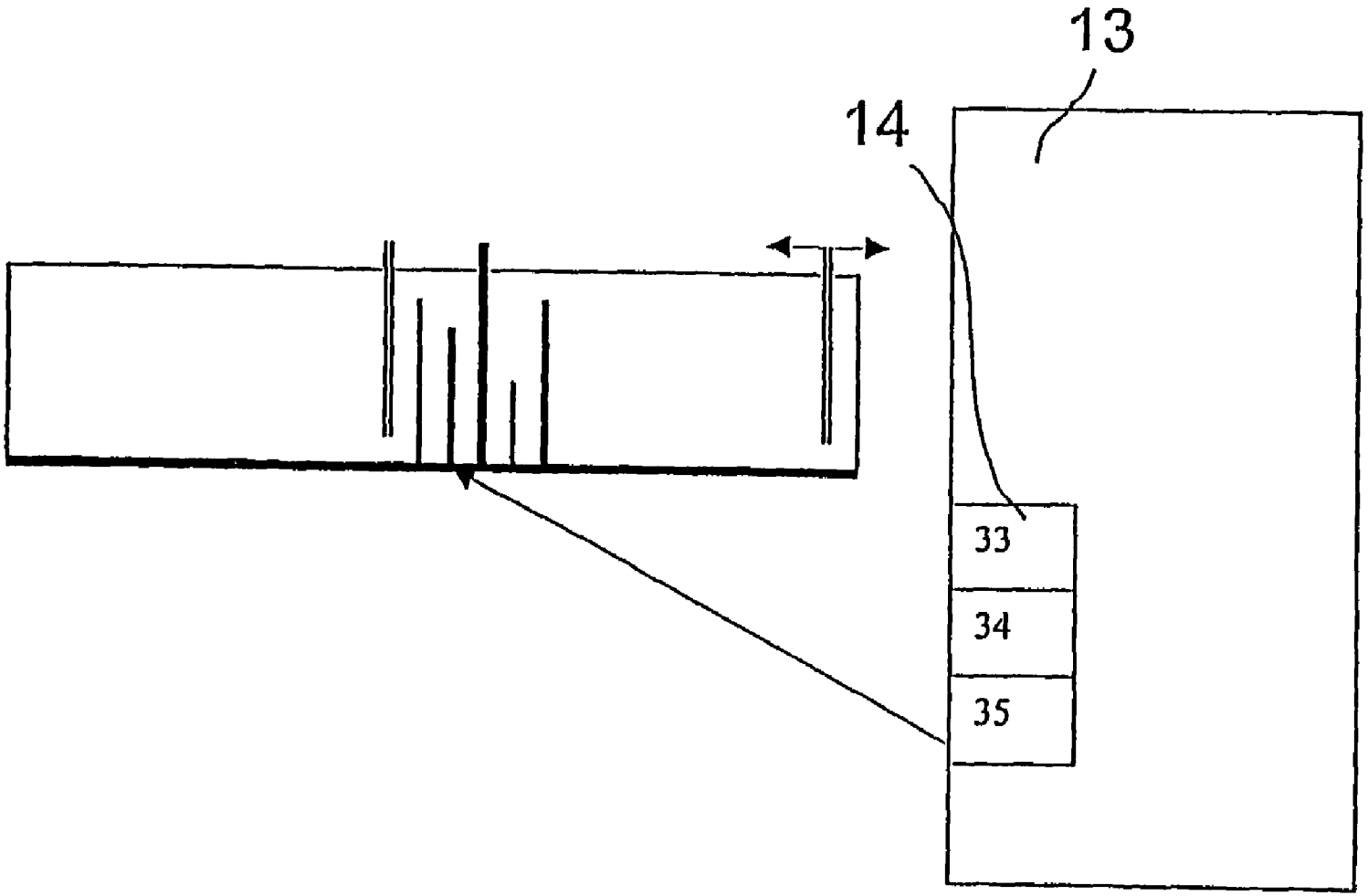

A second loading scheme is suggested with reference to FIG. 2*b*. Herein, the mail pieces are distributed from the front to the back with decreasing numbers. The separating blade no. 2 may stand, initially, in the center of the second section, the stack from the sorting bin 14 with the highest number being then deposited to its right, etc. If the right half of the second section is loaded, this stack is then moved to the left. This process can also occur more often with smaller stacks. The aim of this process is to have the loading station as close as possible to the bin wall so as to minimize the distances during the loading of the second section.

Because the maximal loading degree for the sorting bins can be exceeded in exceptional cases, so-called overflow-bins are provided. These have to also be emptied in the right order (if bin no. 4 is allocated to an-overflow bin no. 4+, bin no. 4 is first emptied and subsequently no. 4+). Therefore, they are efficiently distributed evenly over the sorting plant in such a way, that their emptying can always be outgoing from the stack receiver. The minimal distance is thereby covered for the emptying of the sorting bins on the second section of the mail conveyor line.

A human operator may be guided by usage of lamp tracers as steering gear for the emptying order. For example, the following commands may be assigned:

| | |
|---|---|
| steady light = | bin filled |
| flashing light = | next bin to be emptied |
| no extinction after acknowledgement = | an additional overflow bin has to be emptied. |

After emptying of the entire letter sorting system onto second sections, letters are moved absent rotation to the input unit.

The first section 30 to be emptied is the one with stack from bin no. 1 at its right end. This is the second section standing closest to the input unit for the above described first version. For the second version, this would be the second section at the end of the letter sorting system. The respective second section 30 is first of all docked in extension to the first section 20 of the mail conveyor line of the input unit. The two separating blades 9, 10 are then moved with the first stack to the first separating blade 6. The first separating blade 6 of the input unit is then swiveled upwards and inserted again behind the stack and the rear separating blade 10 of the second section 30. After tilting upward of the separating blade 9, 10 of the second section 30, the separation can be started (FIGS. 3*a–c*). If a second section 30 is separated, the remaining follow in the respective order.

The invention being thus described, it will be obvious that the same may be varied in many ways. The variations are not to be regarded as a departure from the spirit and scope of the invention, and all such modifications as would be obvious to one skilled in the art are intended to be included within the scope of the following claims.

The invention claimed is:

1. A sorting system for a plurality of letters, comprising:

a letter isolating unit, a first conveyor line for conveying letters to said letter isolating unit, said first conveyor line comprising: a first conveyor surface for supporting and transporting said letters; a supporting wall for supporting said letters, said wall running along said first conveyor surface; a first separating blade for supporting said letters and facilitating transport of said letters to said unit; and a linear guide for guiding said first separating blade, said guide running beyond a length of said first conveyor surface; and a second conveyor line for conveying said letters to said first conveyor line, said second conveyor line being mounted on a moveable carriage and comprising: a second conveyor surface for supporting and transporting said letters; coupling means for functionally associating said second conveyor line to said first conveyor line such that letters supported by said second conveyor surface may be transported to said first conveyor surface by said first blade; at least one second blade for supporting and transporting said letters; and a second linear guide for guiding said at least one second blade.

2. The system according to claim 1, wherein said carriage comprises wheels.

3. The system according to claim 1, wherein said first conveyor surface comprises a length sufficient to hold a number of letters whose time of processing by said isolation unit substantially equals a coupling time for exchanging one second conveyor line with another.

4. The system according to claim 1, wherein said first blade and said at least one second blade are positioned on different sides of said first and second conveyor surfaces.

5. The system according to claim 1, further comprising means for urging said first blade, at a constant pressure, in a direction of said isolating unit.

6. The system according to claim 1, wherein said first supporting wall is substantially perpendicular to said first conveyor surface.

7. The system according to claim 1, wherein said first linear guide comprises a length substantially equal to a combined length of said first and second conveyor surface.

8. The system according to claim 7, wherein said first separating blade may run to an end of said first linear guide and without obstruction from said at least one second blade.

9. The system according to claim 1, wherein said first and second conveyor surfaces each comprise: a conveying belt which may be synchronized with movement of said first and at least one second blades for facilitating movement of said letters to said isolating unit; and said conveyor belt for said first and second conveyor surfaces becomes functionally coupled when said first and second conveyor lines couple.

10. The system according to claim 9, wherein said conveying belt comprises a rough conveying belt.

11. The system according to claim 10, wherein functional coupling between said first and second conveyor surfaces is facilitated by friction wheels.

12. The system according to claim 1, wherein said first and at least one second blade are rotatable about said first and second linear guide respectively.

13. The system according to claim 12, wherein said at least one second blade comprises two second blades.

14. The system according to claim 13, wherein said letters form a stack of letters accommodated on said second conveyor surface, and each of said two second blades are positionable at an end of said stack.

15. The system according to claim 14, wherein said two second blades disengage said stack when said first blade transports said letters from said second conveyor line to said first conveyor line.

16. The system according to claim 15, wherein said first blade or said second blades rotate into said stack so as to partition said stack.

17. The system according to claim 15, wherein said first blade and said second blades rotate into said stack so as to partition said stack.

* * * * *